US009074612B2

(12) United States Patent
Studer

(10) Patent No.: US 9,074,612 B2
(45) Date of Patent: Jul. 7, 2015

(54) FLUID OPERATED ACTUATOR INCLUDING A BLEED PORT

(75) Inventor: Roger Studer, Balterswil (CH)

(73) Assignee: Norgren GmbH, Alpen (DE)

( * ) Notice: Subject to any disclaimer, the term of this patent is extended or adjusted under 35 U.S.C. 154(b) by 779 days.

(21) Appl. No.: 13/262,982

(22) PCT Filed: Apr. 27, 2010

(86) PCT No.: PCT/EP2010/002569

§ 371 (c)(1),
(2), (4) Date: Oct. 5, 2011

(87) PCT Pub. No.: WO2010/124840

PCT Pub. Date: Nov. 4, 2010

(65) Prior Publication Data

US 2012/0037238 A1 Feb. 16, 2012

Related U.S. Application Data

(60) Provisional application No. 61/172,840, filed on Apr. 27, 2009.

(51) Int. Cl.

| | |
|---|---|
| ***B21J 7/40*** | (2006.01) |
| ***F15B 11/024*** | (2006.01) |
| ***F15B 15/02*** | (2006.01) |

(52) U.S. Cl.

CPC ..... *F15B 11/024* (2013.01); *B21J 7/40* (2013.01); *F15B 15/02* (2013.01)

(58) Field of Classification Search

CPC ..... F15B 11/024; F03C 1/007; B21J 7/40
USPC ..... 92/181 P, 84; 188/283
See application file for complete search history.

(56) References Cited

U.S. PATENT DOCUMENTS

| | | | | |
|---|---|---|---|---|
| 3,157,070 | A | 11/1964 | Heidrich | |
| 3,469,400 | A | 9/1969 | Oikawa et al. | |
| 4,020,746 | A * | 5/1977 | Arndt | 91/291 |
| 4,862,972 | A * | 9/1989 | Sudinshnikov et al. | 173/121 |
| 2002/0084068 | A1 | 7/2002 | Hugger | |
| 2007/0199320 | A1 | 8/2007 | Yager et al. | |
| 2010/0236881 | A1 * | 9/2010 | Browne et al. | 188/283 |

FOREIGN PATENT DOCUMENTS

| | | | |
|---|---|---|---|
| EP | 0289513 | B1 | 8/1990 |
| EP | 0226915 | 81 | 7/1993 |
| SU | 664831 | A1 | 5/1979 |
| WO | 8704499 | A1 | 7/1987 |
| WO | 8804598 | A1 | 6/1988 |

* cited by examiner

*Primary Examiner* — Nathaniel Wiehe
*Assistant Examiner* — Abiy Teka
(74) *Attorney, Agent, or Firm* — The Ollila Law Group LLC

(57) ABSTRACT

A fluid operated actuator (100) is provided. The fluid operated actuator (100) includes a cylinder body (101) and a piston (102) movable within the cylinder body (101). The piston (102) defines a first chamber (105) and a second chamber (106). The fluid operated actuator (100) can include a fluid inlet (107) formed in the first chamber (105). A bleed port (110) can be formed to provide fluid communication between the first chamber (105) and the second chamber (106).

16 Claims, 6 Drawing Sheets

FLUID OPERATED ACTUATOR INCLUDING A BLEED PORT

TECHNICAL FIELD

The present invention relates to fluid operated actuator. More particularly, the present invention relates to a fluid operated actuator including a bleed port.

BACKGROUND OF THE INVENTION

Fluid operated actuators convert a fluid pressure to a work piece using an actuator that typically consists of a piston in a cylinder. Although there are various suitable fluids that may be used, the fluid applied to the actuator generally comprises pneumatic or hydraulic fluid, for example. Pneumatic operated actuators are generally used where the compressibility of air is desired or to obtain much higher flow rates and thus faster response times while hydraulic operated actuators are generally employed when high actuating forces are required. Both fluids have advantages and in some situations, either pneumatic or hydraulic fluid may be used.

Although fluid operated cylinders are generally known in the art, one particular type of fluid operated cylinder comprises an impact cylinder. Impact cylinders, also known as drop hammers, are generally known in the art and used for a variety of applications. Impact cylinders may be powered using a variety of different fluids or other actuators; however, it is particularly common to use fluid pressure, such as pneumatic or hydraulic fluid, to pressurize the impact cylinder. Generally, fluid pressure is introduced into a first fluid chamber resulting in the movement of a piston. Towards the end the piston's stroke, it collides with a secondary piston or other striking member. The striking member then rapidly extends from the cylinder body, thereby impacting some work piece. Another variation is to omit the striking member and have a piston rod, coupled to the piston, strike the work piece directly.

Impact cylinders can be used for a number of applications. For example, in waste combustion plants, deposits can form on the exhaust pipes resulting in the pipes becoming clogged. An impact cylinder can be coupled to the exhaust pipes and when actuated, the striking pin impacts the exterior of the pipe to break loose and de-cake the inside of the pipe. With a single strike of the striking pin, the pipe can continue to vibrate to break loose more deposits.

Although impact cylinders have received great success, one potential problem encountered when using impact cylinders is rebound striking by the striking pin. Rebound striking can occur when the striking pin impacts either the work piece or the piston multiple times during the course of a single piston stroke. In use, the rear cylinder chamber of the main piston is rapidly pressurized in order to actuate the piston with sufficient force and speed. However, after actuation, this pressure remains in the rear cylinder and also acts on the striking pin, preventing the striking pin from fully retracting. If this pressure is not exhausted, the striking pin can impact the work piece multiple times, which may not be desirable. Prior art attempts to provide exhaust valves to vent the rear cylinder chamber typically takes a significant amount of time and requires complex control systems and large ventilators resulting in increased expense.

Therefore, there exists a need for an impact cylinder that can rapidly compensate for the force acting on the main piston after the impact cylinder has been actuated. The present invention overcomes this and other problems and an advance in the art is achieved.

SUMMARY OF THE INVENTION

A fluid operated actuator is provided according to an embodiment of the invention. The fluid operated actuator can include a cylinder body and a piston. According to an embodiment of the invention, the piston is movable within the cylinder body. According to an embodiment of the invention, the piston defines a first chamber and a second chamber. The fluid operated actuator can include a fluid inlet formed in the first chamber. According to an embodiment of the invention, a bleed port can be formed to provide fluid communication between the first chamber and the second chamber.

According to an embodiment of the invention, a method for operating a fluid operated actuator is provided. The fluid operated actuator includes a piston movable within a cylinder and defining a first chamber and a second chamber. The fluid operated actuator also includes an inlet formed in the first chamber and a bleed port providing fluid communication between the first chamber and the second chamber. According to an embodiment of the invention, the method comprises the steps of pressurizing the first chamber through the inlet and actuating the piston away from a first position towards a second position. The method also comprises the step of bleeding at least some of the pressure in the first chamber into the second chamber through the bleed port as the piston is actuated towards the second position.

A fluid operated actuator is provided according to an embodiment of the invention. The fluid operated actuator can include a cylinder body and a piston. According to an embodiment of the invention, the piston is movable within the cylinder body. According to an embodiment of the invention, the piston defines a first chamber and a second chamber. The fluid operated actuator can include a fluid inlet formed in the first chamber. According to an embodiment of the invention, an adjustable relief valve can be coupled to the cylinder body and configured to regulate a pressure in the first chamber.

According to an embodiment of the invention, an adjustable relief valve for a fluid operated actuator comprises a valve housing and a poppet movable within a poppet chamber formed in the valve housing. A biasing member can be coupled to the poppet. According to an embodiment of the invention, an adjustable member is provided that is movable within the valve housing and adapted to adjust a biasing force acting on the poppet by the biasing member.

According to an embodiment of the invention, a method for controlling a pressure in a fluid operated actuator is provided. The fluid operated actuator includes a cylinder body and a piston movable within the cylinder body. The piston defines a first chamber and a second chamber. The fluid operated actuator also includes a fluid inlet formed in the first chamber. The fluid operated actuator also includes an adjustable relief valve coupled to the first chamber. The method comprises the step of biasing a poppet of the adjustable valve against a valve seat formed in an exhaust formed in the first chamber with a biasing member. The method also comprises adjusting a biasing force of the biasing member with an adjustable member coupled to the biasing member. The method further comprises actuating the poppet away from the valve seat when a pressure in the first chamber reaches a threshold pressure required to overcome the biasing force, thereby regulating a pressure in the first chamber acting on the piston.

Aspects

According to an aspect of the invention, a fluid operated actuator comprises:

a cylinder body;

a piston movable within the cylinder body between a first position and a second position, the piston defining a first chamber and a second chamber;

a fluid inlet formed in the first chamber; and a bleed port providing fluid communication between the first chamber and the second chamber.

Preferably, the fluid operated actuator further comprises a striking pin positioned within the second chamber.

Preferably, the fluid operated actuator further comprises a biasing member coupling the striking pin to the piston.

Preferably, the bleed port is formed in the piston.

Preferably, the bleed port is formed in the cylinder body.

Preferably, the bleed port comprises a cross sectional area smaller than the inlet port.

Preferably, the fluid operated actuator further comprises a fluid outlet formed in the second chamber.

Preferably, the fluid operated actuator further comprises a check valve positioned in the fluid outlet.

Preferably, the fluid operated actuator further comprises an exhaust port formed in the first chamber.

Preferably, the fluid operated actuator further comprises an adjustable valve configured to control fluid communication between the first chamber and the exhaust port.

According to another aspect of the invention, a method for controlling a fluid operated actuator including a piston movable within a cylinder and defining a first chamber and a second chamber, an inlet formed in the first chamber, and a bleed port providing fluid communication between the first chamber and the second chamber, the method comprises the steps of:

pressurizing the first chamber through the inlet;

actuating the piston away from a first position towards a second position; and bleeding at least some of the pressure in the first chamber into the second chamber through the bleed port as the piston is actuated towards the second position.

Preferably, the method further comprises the step of impacting a striking pin with the piston as the piston reaches the second position.

Preferably, the method further comprises the step of exhausting the first chamber thereby actuating the piston from the second position towards the first position.

Preferably, the method further comprises the step retracting a striking pin using a biasing member as the piston moves from the second position towards the first position.

Preferably, the method further comprises the step of actuating a check valve provided in a fluid outlet formed in the second chamber to open the fluid outlet thereby exhausting the second chamber.

Preferably, the method further comprises the step of regulating the pressure within the first chamber using a pressure relief valve.

Preferably, the pressure relief valve comprises an adjustable pressure relief valve.

Preferably, the bleed port is formed in the piston.

Preferably, the bleed port is formed in the cylinder body.

DETAILED DESCRIPTION OF THE INVENTION

FIGS. 1-6 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
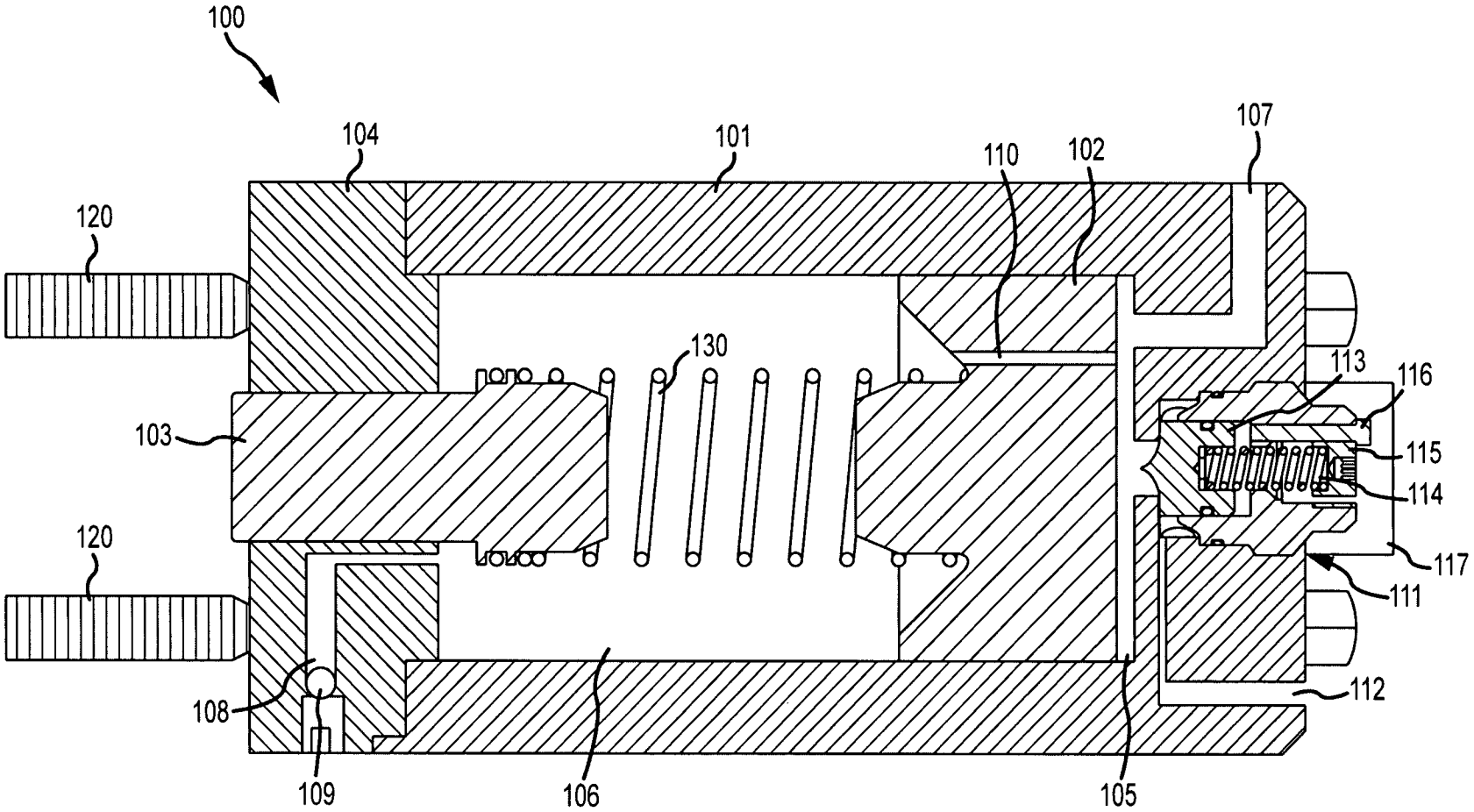
FIG. 1 shows a partial cross-sectional view of an impact cylinder according to an embodiment of the invention.

FIG. 1 shows a partial cross-sectional view of a fluid operated actuator 100 according to an embodiment of the invention. According to the embodiment shown, the fluid operated actuator 100 comprises an impact cylinder 100. Although an impact cylinder is described below, it should be appreciated that the present invention is not limited to impact cylinders, but rather the present invention may be utilized with any kind of fluid operated actuator. The invention is particularly well suited for fluid operated actuators that require pressure compensation after a fast initial stroke. The impact cylinder 100 comprises a cylinder body 101, a piston 102, a striking pin 103, and an end cap 104. According to an embodiment of the invention, the end cap 104 can be coupled to the cylinder body 101 after the internal components have been inserted. The end cap 104 may be coupled to the cylinder body 101 according to known methods including, for example adhesives, welding, brazing, bonding, mechanical fasteners, etc. The particular method used to couple the end cap 104 to the cylinder body 101 should not limit the scope of the present invention. According to another embodiment of the invention, the end cap 104 can be omitted and the cylinder body 101 can be formed around the internal components. According to an embodiment of the invention, the impact cylinder 100 can also include fasteners 120. The fasteners 120 may comprise bolts or screws, or some other type of fastener. The fasteners 120 can be provided to couple the impact cylinder 100 to a work piece or some other device.

According to an embodiment of the invention, the piston 102 can be movable within the cylinder body 101 between a first position (shown in FIG. 1) and at least a second position (towards the striking pin 103). The piston 102 may include one or more sealing members (not shown) to provide a substantially fluid tight seal between the piston 102 and the cylinder body 101. According to an embodiment of the invention, the piston 102 separates the cylinder body 101 into a first chamber 105 and a second chamber 106. The first chamber 105 may be pressurized via a fluid inlet 107. The fluid inlet 107 may be formed in the first chamber 105 as shown. The pressurized fluid may comprise pneumatic, hydraulic, or some other fluid. Therefore, when pressurized fluid is initially supplied to the impact cylinder 100, the first chamber 105 becomes pressurized and as a result, the piston 102 is actuated away from a first position, which is the position shown in FIG. 1, towards a second position, which is towards the striking pin 103. As the first chamber 105 is pressurized, the piston 102 can be actuated towards the striking pin 103 and can eventually impact the striking pin 103. As a result of the impact from the piston 102, the striking pin 103 rapidly extends from the cylinder body 101 to collide or otherwise impact an exterior work piece, such as a pipe, for example. The pressurized fluid being supplied to the inlet port 107 can then be shut off and an exhaust valve may be actuated to open an exhaust port 112 in order to exhaust the first chamber 105. According to the embodiment shown, the exhaust valve comprises an adjustable valve 111; however, it should be appreciated that the exhaust valve may comprise any type of exhaust valve and the particular valve chosen should not limit the scope of the present invention. The exhaust valve 111 may be actuated in a variety of ways including, but not limited to solenoid actuated, fluid actuated, pilot actuated, manually actuated, etc. In some embodiments, the exhaust port 112 may not be able to exhaust the pressure within the first chamber 105 fast enough to prevent the striking pin 103 from rebound striking. Another undesirable condition may exist if the striking pin 103 bounces off from the work piece and the piston 102 and the pressure within the first chamber 105 is still elevated such that the piston 102 remains in an actuated position thereby colliding with the striking pin 103 a second time as the striking pin bounces off from the work piece. Both of these conditions can be substantially reduced according to the present invention.

According to an embodiment of the invention, the cylinder 100 can be provided with a bleed port 110. The bleed port 110 may provide fluid communication between the first and second fluid chambers 105, 106. Although the bleed port 110 is shown as being formed in the piston 102, it should be appreciated that the bleed port 110 may be formed in the cylinder body 101 instead (See FIG. 2). According to the embodiment shown in FIG. 1, the cross sectional area of the bleed port 110 is smaller than the cross sectional area of the inlet port 107. Therefore, although pressurized fluid in the first chamber 105 can communicate with the second chamber 106 via the bleed port 110, the smaller cross sectional area of the bleed port 110 results in the pressure in the first chamber 105 increasing faster than the pressure in the second chamber 106. As a result, the piston 102 can still be actuated and strike the striking pin 103 before the fluid between the first chamber 105 and the second chamber 106 can equilibrate. However, the bleed port 110 allows the pressure in the second chamber 106 to increase and thus, at least partially compensates for the increased pressure in the first chamber 105. The pressure in the second chamber 106 will also increase due to the reduced volume as the piston 102 is actuated towards the second position. With the bleed port 110 provided, once the pressure is no longer being supplied to the inlet port 107, the piston 102 substantially immediately begins to return towards its first position as some of the fluid in the high pressure first chamber 105 bleeds into the lower pressure second chamber 106.

According to an embodiment of the invention, the piston 102 can be coupled to the striking pin 103 via a biasing member 130. In other embodiments, the striking pin 103 may be formed as a part of the piston 102, for example, the striking pin 103 may comprise a piston rod (See FIG. 3). The biasing member 130 may comprise a spring as shown, or may comprise some other biasing member. The biasing member 130 may be provided to bias the striking pin 103 towards the piston 102. Therefore, as the piston 102 returns to its rest position, the biasing member 130 can act to pull the striking pin 103 back into the cylinder body 101. This substantially immediate withdrawal of both the piston 102 and the striking pin 103 can prevent the striking pin 103 from rebound striking the work piece. It should be appreciated that in other embodiments, the biasing member 130 can be omitted and the striking pin 103 can be pulled back into the cylinder body 101 according to other methods including, for example, using gravity and the weight of the striking pin 103, magnets, solenoids, manually, etc. Therefore, the present invention should not be limited to embodiments including the biasing member 130.

In addition to decreasing the pressure in the first chamber 105 via the bleed port 110, the adjustable valve 111 can also be actuated in order to remove the pressurized fluid from the first chamber 105 via the first chamber exhaust 112. The adjustable valve 111 may be actuated once the piston 102 has completed its stroke, for example. The adjustable valve 111 may comprise a variety of different types of valves; however, the adjustable valve 111 shown in FIG. 1 comprises an adjustable poppet style valve comprising a poppet 113, a biasing member 114, an adjusting member 115, a locking pin 116, and a protective cap 117. According to an embodiment of the invention, the adjustable valve 111 may be utilized to both exhaust the first chamber 105 when actuated, but also function as a pressure relief valve that can regulate the pressure within the first chamber 105. For example, if it is desired to provide a pressure of 5 bar to the first chamber 105, however the pressurized fluid source is set to 10 bar, the adjustable valve 111 can be adjusted to open at just above 5 bar. The adjustment may be accomplished using the adjusting member 115, which can adjust the compression of the biasing member 114 that biases the poppet 113 against the exhaust 112. Once the adjustable valve 111 is set to the desired position, the locking pin 116 can be inserted into the adjustable valve 111 in order to retain the adjusting member 115 in the set position. Advantageously, the adjustment member 115 will not fall out of place due to vibrations or other external forces. The cap 117 can then be coupled to the adjustable valve 111 in order to protect the adjustable valve 111 from dirt and debris. With the adjustable valve 111 set to just above 5 bar, pressure within the first chamber 105 can be retained around 5 bar regardless of the inlet pressure supplied to the inlet port 107. It should be appreciated that the pressures described above are merely examples and the particular operating pressures may differ. Therefore, the present invention should not be limited to the pressures described above.

In order to exhaust the first chamber 105, the adjustable valve 111 can be actuated to open a fluid flow path between the first chamber 105 and the exhaust 112. Although not shown, the adjustable valve 111 may include an actuation means, such as a solenoid, for example. Other methods of actuating the adjustable valve 111 are known as discussed above, and the particular method used should not limit the scope of the present invention. According to an embodiment of the invention, the exhaust 112 has a larger cross sectional area than the bleed port 110. As a result, fluid in the first chamber 105 can exit the actuator 100 through the exhaust 112 faster than it can flow through the bleed port 110. Therefore, once the exhaust 112 is opened, the piston 102 can rapidly return to its first rest position. As the pressure in the first chamber 105 decreases, some of the fluid pressure within the second chamber 106 may flow through the bleed port 110. The remaining pressure in the second chamber 106 can be exhausted from the system through the fluid outlet 108.

According to an embodiment of the invention, the fluid outlet 108 can be formed in the second chamber 106. In some embodiments, the fluid outlet 108 may also include a check valve 109. In some embodiments, the fluid outlet 108 may be in communication with a pressurized fluid source. The pressurized fluid source may be used to close the check valve 109, for example. According to an embodiment of the invention, the pressurized fluid source acting on the check valve 109 may comprise the same fluid source that delivers pressurized fluid to the inlet port 107. However in other embodiments, the check valve 109 may be supplied with pressure from a separate source and therefore, the particular fluid source acting on the check valve 109 should not limit the scope of the present invention. The check valve 109 may be provided to prevent fluid from exiting the fluid outlet 108 when the pressurized fluid source is provided. In other words, the pressurized fluid source may keep the check valve 109 from opening thereby preventing any premature exhausting of the second fluid chamber 106. Once the pressure is removed from the check valve 109, fluid within the second fluid chamber 106 may be free to exit through the fluid outlet 108 formed in the second fluid chamber 106. According to an embodiment of the invention, the check valve 109 may be retained closed during actuation of the piston 102 from the first position towards the second position in order to prevent fluid in the second chamber 106 from exhausting prematurely and eliminating the advantages created by the bleed port 110. In other embodiments, the fluid outlet 108 can be omitted and substantially all of the pressure within the second chamber 106 can be exhausted through the exhaust 112.

In use, the cylinder 100 starts in an initial rest or first piston position. This is the position shown in FIG. 1. With the piston 102 in its first position, the biasing member 130 can act to bias the striking pin 103 towards a retracted position. Furthermore, the first and second chambers 105, 106 can be substantially depressurized or may comprise equal pressures. To actuate the piston 102, pressurized fluid can be supplied to the first chamber 105 via the inlet port 107. In some embodiments, pressurized fluid may also be supplied to the check valve 109 to prevent fluid in the second chamber 106 from exhausting through port 108. The pressure created in the first chamber 105 actuates the piston 102 such that the piston 102 moves within the cylinder body 101 from a first position to a second position. According to an embodiment of the invention, the second position is towards the striking pin 103. Once the piston 102 impacts the striking pin 103, the striking pin 103 extends from the cylinder body 101 due to the force of the piston 102. As described above, as the piston 102 is being actuated, a portion of the fluid in the first chamber 105 bleeds into the second chamber 106 via the bleed port 110 formed in the piston 102. Therefore, the pressure in the second chamber 106 increases in response to the moving piston 102. The pressure in the second chamber 106 increases due to the reduction in volume of the second chamber 106 as well as the pressure bleeding into the second chamber 106 from the first chamber 105 via the bleed port 110. As a result, the increased pressure in the second chamber 106 can partially compensate or cushion the force from pressure in the first chamber 105 acting on the piston 102 with the increased pressure in the second chamber 106. Therefore, the piston 102 is less susceptible to rebound striking.

Once it is desired to return the piston 102 to its first position, the pressure supplied to the first chamber 105 via the inlet port 107 can be removed and the exhaust valve 111, which may comprise the adjustable valve 111, can be actuated, thereby opening the exhaust port 112. With the exhaust port 112 open to the first chamber 105, the first chamber 105 can begin to exhaust. With the pressure still in the second chamber 106, the piston 102 is actuated back towards the first position. Because the bleed port 110 is much smaller than the exhaust port 112, fluid is exhausted from the first chamber 105 at a faster rate than it is supplied from the second chamber 106 via the bleed port 110.

In addition to the opening of the exhaust 112, the pressure being applied to the check valve 109 can be removed thereby allowing fluid remaining in the second chamber 106 to be exhausted through the fluid outlet 108.

Figure 2:
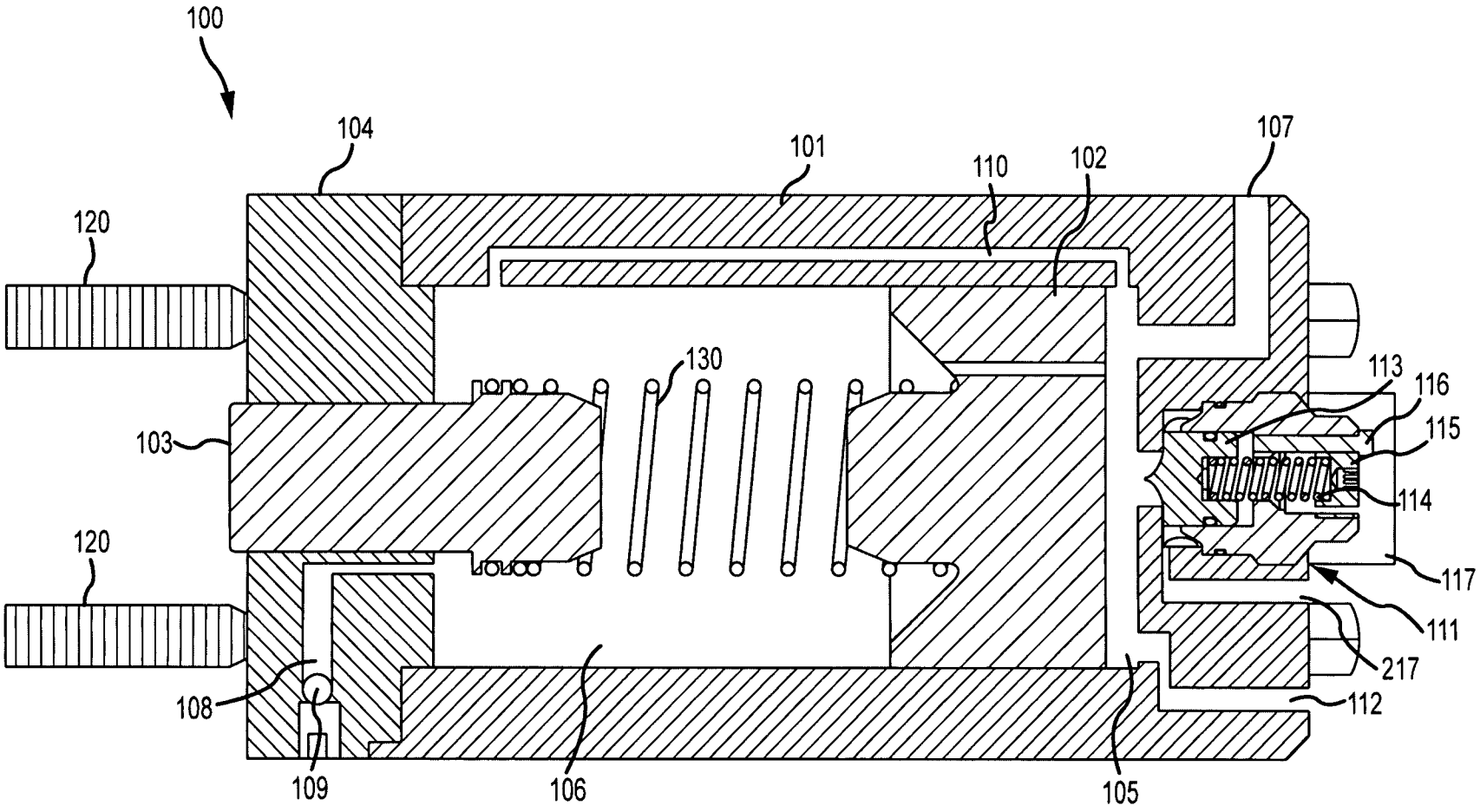
FIG. 2 shows a partial cross-sectional view of the impact cylinder according to another embodiment of the invention.

FIG. 2 shows the cylinder 100 according to another embodiment of the invention. The cylinder 100 shown in FIG. 2 is similar to the cylinder shown in FIG. 1 with a few exceptions. In FIG. 2, the bleed port 110 is formed in the cylinder body 101 rather than in the piston 102. However, the function and capabilities of the bleed port 110 shown in FIG. 2 are comparable to the embodiment shown in FIG. 1. It should also be appreciated that the bleed port 110 may be formed outside of the cylinder body 101 using a separate conduit, for example.

In addition, the embodiment shown in FIG. 2 includes a separate pressure relief port 217. The pressure relief port 217 can be provided to exhaust the first chamber 105 if the pressure exceeds a threshold pressure. The threshold pressure may be adjusted by adjusting the pressure relief valve 111 as described further below. By providing separate and distinct pressure relief ports 217 and exhaust ports 112 a number advantages can be realized. According to some embodiments, the pressure relief valve 111 can be adjusted to a desired threshold pressure and no further input is required to open the pressure relief port 217. Rather, if the pressure within the first chamber 105 exceeds the threshold pressure, the pressure relief valve 111 will open automatically.

Another advantage to providing a separate pressure relief port 217 is that fluid through the inlet port 107 and the exhaust port 112 may be controlled using a single valve. For example, a 2/2 valve may be utilized where pressurized fluid is supplied to the inlet port 107 and the exhaust port 112 is closed when the valve is in a first position and where the fluid supply is closed off from the inlet port 107 and the exhaust port 112 is opened when the valve is in a second position. In some embodiments, the fluid outlet 108 and the exhaust port 112 may be coupled such that both can be operated substantially simultaneously in order to completely vent the cylinder 100. It should be appreciated that the valves described may comprise generally known valves and therefore the particular manner of actuation has been omitted.

Figure 3:
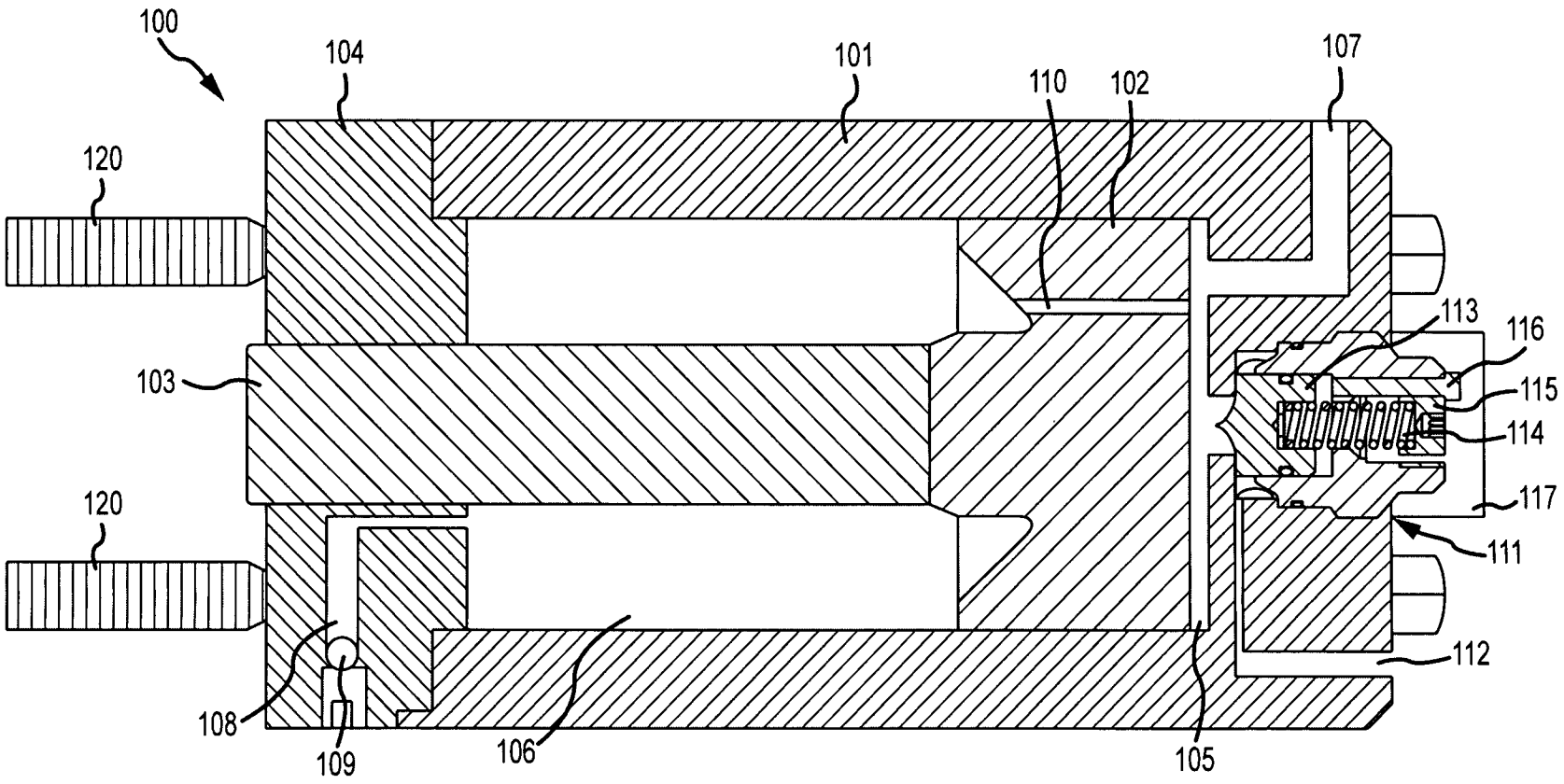
FIG. 3 shows a partial cross-sectional view of the impact cylinder according to another embodiment of the invention.

FIG. 3 shows the cylinder 100 according to another embodiment of the invention. In the embodiment shown in FIG. 3, the striking pin 103 is coupled directly to the piston 102 and forms a piston rod. Therefore, the biasing member 130 is no longer necessary. The operation of the cylinder 100 of FIG. 3 is similar to the previously described embodiments. However, the piston 102 no longer impacts the striking pin 103; rather the striking pin 103 is actuated with the piston 102. Therefore, the cylinder 100 essentially comprises a traditional piston/cylinder arrangement however, the piston 102 is provided with the bleed port 110. Therefore, it should be appreciated that the present invention is not limited to impact cylinders as described for the previous embodiments. It should also be appreciated that the embodiment shown in FIG. 3 could be combined with the embodiments shown in FIG. 2, for example.

In some embodiments, the fluid actuated cylinder 100 may be connected to a centralized fluid source with multiple fluid actuated cylinders connected in series. Therefore, certain measures may need to be taken in order to prevent loss of the pressurized fluid. This is described further below with reference to FIG. 4.

Figure 4:
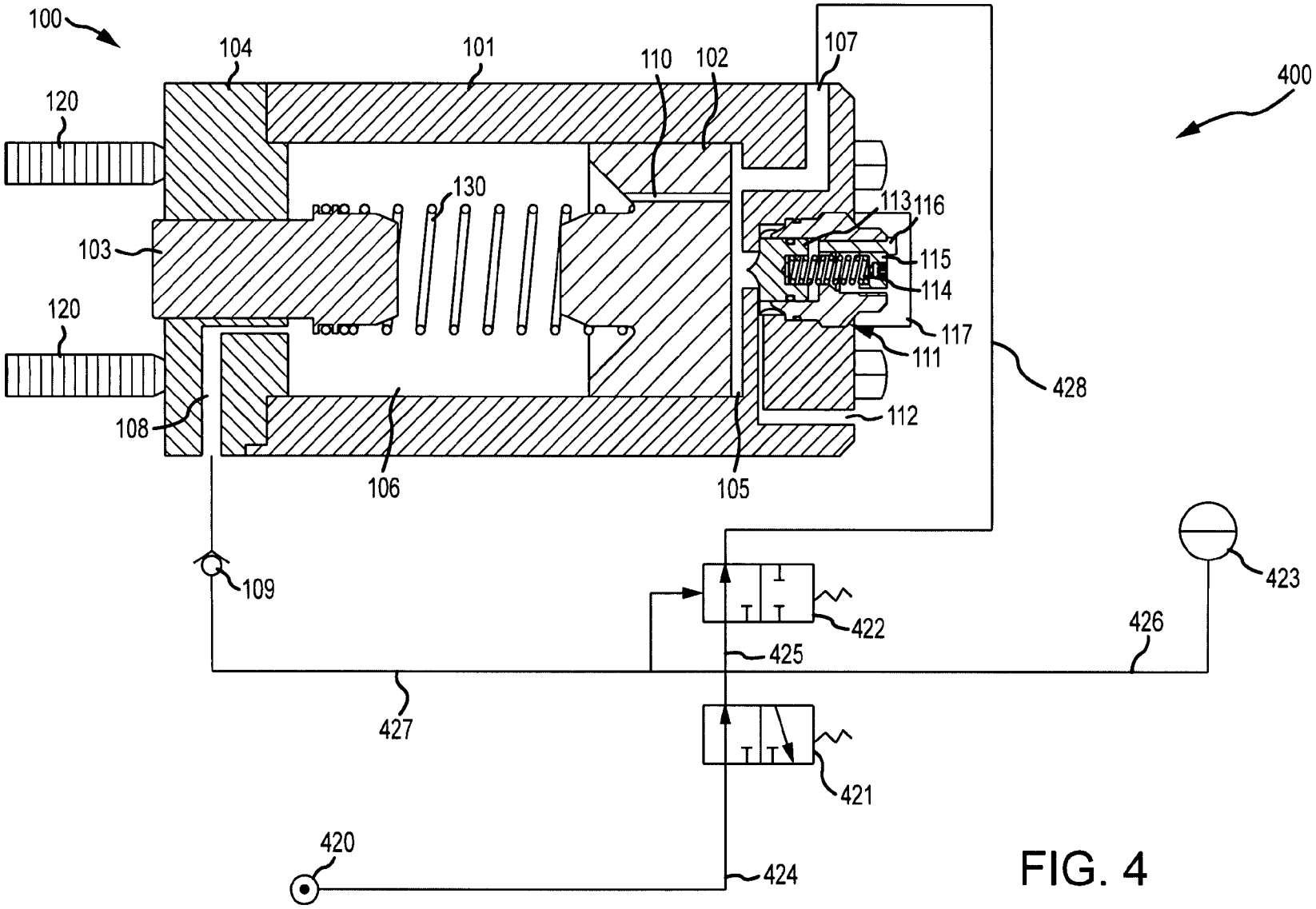
FIG. 4 shows a schematic of the impact cylinder powered by a centralized fluid source.

FIG. 4 shows a simplified schematic of an impact cylinder system 400 according to an embodiment of the invention. The system 400 includes the impact cylinder 100 coupled to a centralized fluid source 420 according to an embodiment of the invention. The electronics for actuating the valves have been omitted to simplify the drawings. As shown, the embodiment in FIG. 4 includes the centralized fluid source 420, a first control valve 421, a second control valve 422, and a fluid reservoir 423. The system shown in FIG. 4 may be advantageous in situations where the impact cylinder 100 shares the centralized fluid source 420 with one or more other devices (not shown). If other devices also utilize the centralized fluid source 420, the pressure may fluctuate if appropriate precautionary steps are not taken.

As shown, the first control valve 421 can control the delivery of the pressurized fluid from the centralized fluid source 420 to the cylinder 100. According to the embodiment shown, the valve 421 comprises a 3/2 valve; however, it should be appreciated that the valve 421 may comprise a variety of configurations and the particular valve configuration chosen should not limit the scope of the present invention. With the valve 421 actuated to open a fluid flow path from the centralized fluid source 420 to the cylinder 100, the fluid can be delivered to the second valve 422 via the line 425. The line 425 also branches off into line 427, which provides fluid communication to the check valve 109 and the fluid outlet 108. The line 425 also branches off to line 426, which provides fluid communication to the reservoir 423. The functions of these branches will be described in more detail below.

According to an embodiment of the invention, the second control valve 422 can be provided to open a fluid flow path from the first control valve 421 to the fluid inlet 107 of the cylinder 100 via line 428.

Operation of the system shown in FIG. 4 can be accomplished as follows. With the piston 102 in a first piston position as shown in FIG. 4, the first control valve 421 can be actuated according to known methods. Once actuated, the valve 421 can open a fluid flow path via line 424 from the centralized fluid source 420 and the check valve 109, the second control valve 422, and the fluid reservoir 423. It should be appreciated that once the first valve 421 is actuated, the check valve 109 can be closed by the pressure delivered via the line 427, thereby preventing fluid from escaping from the second chamber 106 through the fluid outlet 108. In addition, with the first control valve 421 actuated, the fluid reservoir 423 can be pressurized. The fluid reservoir 423 may be advantageous in preventing a rapid loss of pressure delivered to the cylinder 100 in the event that multiple additional devices are actuated at the same time, thereby temporarily depleting the pressure of the centralized fluid source 420.

According to an embodiment of the invention, the pressure supplied from the first control valve 421 can also be used to actuate the second control valve 422 once the pressure acting on the second control valve 422 reaches a threshold pressure. The threshold pressure may not be reached immediately upon actuating the first control valve 421 if the reservoir 423 needs to be filled as the majority of pressure will be delivered to the reservoir 423. It should be appreciated that in other embodiments, the second control valve 422 may be actuated according to other known methods rather than relying upon the pressure supplied via the first control valve 421. Once the threshold pressure is reached, or the second control valve 422 is otherwise actuated, fluid can be delivered to the fluid inlet 107 of the cylinder 100 via the supply line 428. As fluid is delivered to the fluid inlet 107, the cylinder 100 can be actuated as discussed above.

The pressure delivered to the fluid inlet 107 can act on the piston 102 to actuate the piston 102 from the first position towards the second position. In addition to the actuation of the piston 102, a portion of the pressurized fluid delivered to the first chamber 105 can bleed into the second chamber 106 via the bleed port 110. Therefore, the pressure within the second chamber 106 is also increased. If the pressure within the first chamber 105 exceeds a threshold pressure, the adjustable valve 111 may actuate to relieve or otherwise regulate the pressure within the first chamber 105.

Once the piston 102 reaches or nears the end of its stroke, the first control valve 421 can be de-actuated, thereby closing off the pressurized fluid source from the first control valve 421. As the pressure within the reservoir 423 begins to drain, the pressure actuating the second control valve 422 will also decrease and eventually the second control valve 422 can de-actuate thereby closing off the pressurized source to the inlet 107. The de-actuation of the first control valve 421 may be determined based on a predetermined actuation time, for example. Other methods of control are contemplated including a position sensor (not shown) on the piston 102 or the striking pin 103, for example.

Upon de-actuating the second valve 422, the adjustable valve 111 may substantially simultaneously be actuated to exhaust the first chamber 105. Actuation of the adjustable valve 111 may be accomplished according to generally known methods including a solenoid, or some other electrical actuation, fluid actuation, etc. The particular method used for actuating the adjustable valve 111 should not limit the scope of the present invention. As the first chamber 105 exhausts through the exhaust port 112, the piston moves back towards the first position.

With the first control valve 421 de-actuated and open to exhaust, the pressure acting on the check valve 109 also decreases. Once the pressure acting on the check valve 109 drops below the pressure in the second chamber 106, the check valve 109 will open to allow the second chamber 106 to exhaust.

Figure 5:
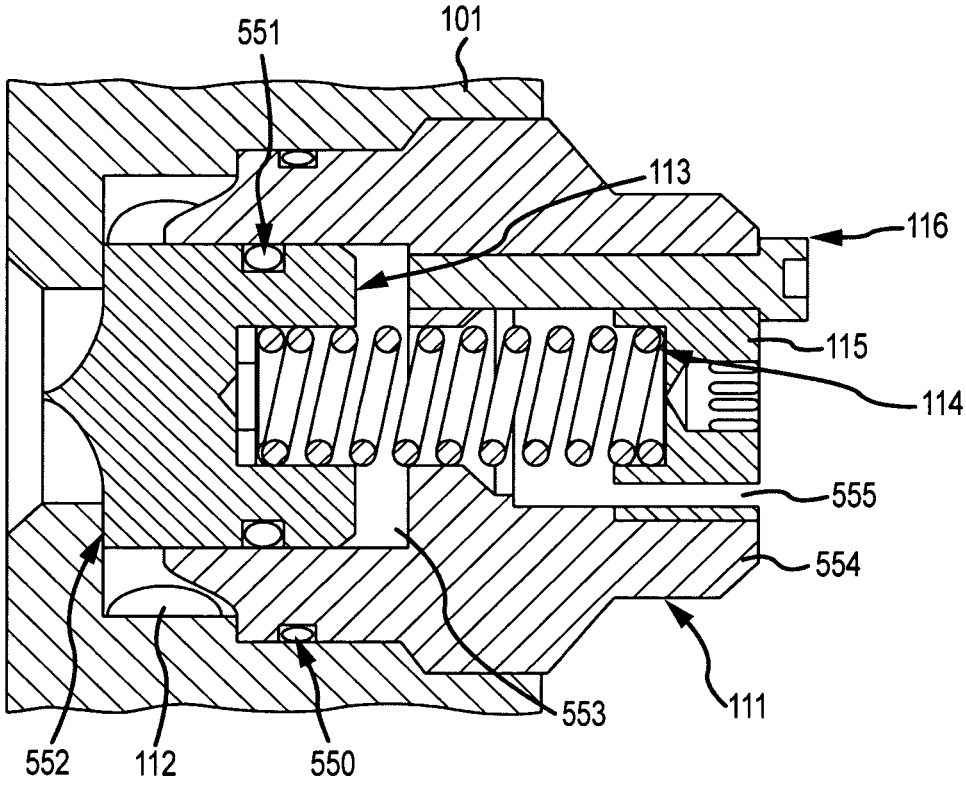
FIG. 5 shows a cross sectional view of an adjustable valve according to an embodiment of the invention.

FIG. 5 shows the adjustable valve 111 according to an embodiment of the invention. FIG. 5 shows the adjustable valve 111 in a little more detail than previously shown. As can be seen, the adjustable valve 111 can be inserted into the cylinder housing 101 and sealed using sealing members 550. The sealing members 550 may comprise O-rings, for example; or may comprise some other sealing member. Advantageously, the sealing members 550 can provide a substantially fluid tight seal between the adjustable valve 111 and the cylinder housing 101. According to an embodiment of the invention, the adjustable valve 111 can be positioned within the cylinder housing 101 such that the poppet 113 seals against a valve seat 552 formed in the end of the cylinder 100. One of the poppet 113 or the valve seal 552 may include a sealing member (not shown) to aid in the fluid tight seal formed when the poppet 113 rests against the valve seal 552.

According to an embodiment of the invention, the adjustable valve 111 also includes a biasing member 114. The biasing member 114 can be provided to bias the poppet 113 against the valve seal 552. Advantageously, the poppet 113 can be sized such that the poppet 113 is movable within a poppet chamber 553 formed in the adjustable valve 111. According to an embodiment of the invention, the poppet 113 can be provided with a sealing member 551 that provide a substantially fluid tight seal between the poppet 113 and the poppet chamber 553.

As discussed briefly above, the adjustable valve 111 may be provided as a pressure relief valve in the end of the impact cylinder 100. Therefore, if the pressure within the first chamber 105 exceeds a threshold pressure, the adjustable valve 111 will actuate to relieve the excess pressure. Advantageously, the pressure within the first chamber 105 can be regulated using the adjustable valve 111. The threshold pressure at which the adjustable valve 111 actuates can be adjusted using the adjustable member 115. The adjustable member 115 may engage the adjustable valve housing 554 using threads (not shown). The threads allow the adjustable member 115 to be screwed inward or outward (left to right as shown in FIG. 5) in order to adjust the compression of the biasing member 114. As the biasing member 114 is coupled between the poppet 113 and the adjustable member 115, the force required to unseat the poppet 113 is determined at least in part by the compression experienced by the biasing member 114. As can be appreciated, in order to increase the threshold pressure at which the poppet 113 unseats from the valve seat 552, the adjustable member 115 can be screwed inward, thereby compressing the biasing member 114. Conversely, to decrease the threshold pressure at which the poppet 113 unseats from the valve seat 552, the adjustable member 115 can be screwed outward, thereby relieving some of the compression of the biasing member 114. It should be appreciated that the allowable threshold pressure range can be determined based on the particular biasing member 114 used.

Once the desired compression is reached, a locking pin 116 can be inserted. The locking pin 116 can engage the adjustable member 115 and the valve housing 554 in order to lock the position of the adjustable member 115. Therefore, with the locking pin 116 in place, the adjustable member 115 will not move and thereby change the threshold pressure under vibrations caused by operation of the cylinder 100. According to an embodiment of the invention, the locking pin 116 can engage a groove 555 formed in the adjustable member 115. Although only one groove 555 is shown in FIG. 5, it should be appreciated that the locking pin 116 is engaging another groove that is not visible with the locking pin 116 in place. The adjustable member 115 may include any number of grooves 555 and the particular number of grooves may depend upon the number of lockable positions desired. For example, in the embodiment shown, the adjustable member 115 includes two lockable positions because two grooves are provided. Therefore, the adjustable member 115 can be locked into place every one-half of a turn. It should be appreciated however, that any number of lockable positions may be provided.

It should be appreciated that while the adjustable valve 111 is shown in conjunction with the impact cylinder 100, the adjustable valve 111 can be used with any type of impact cylinder. Therefore, it is not required that the adjustable valve 111 be used with an impact cylinder that includes a bleed port, for example. Such a configuration is shown for example in FIG. 6.

Figure 6:
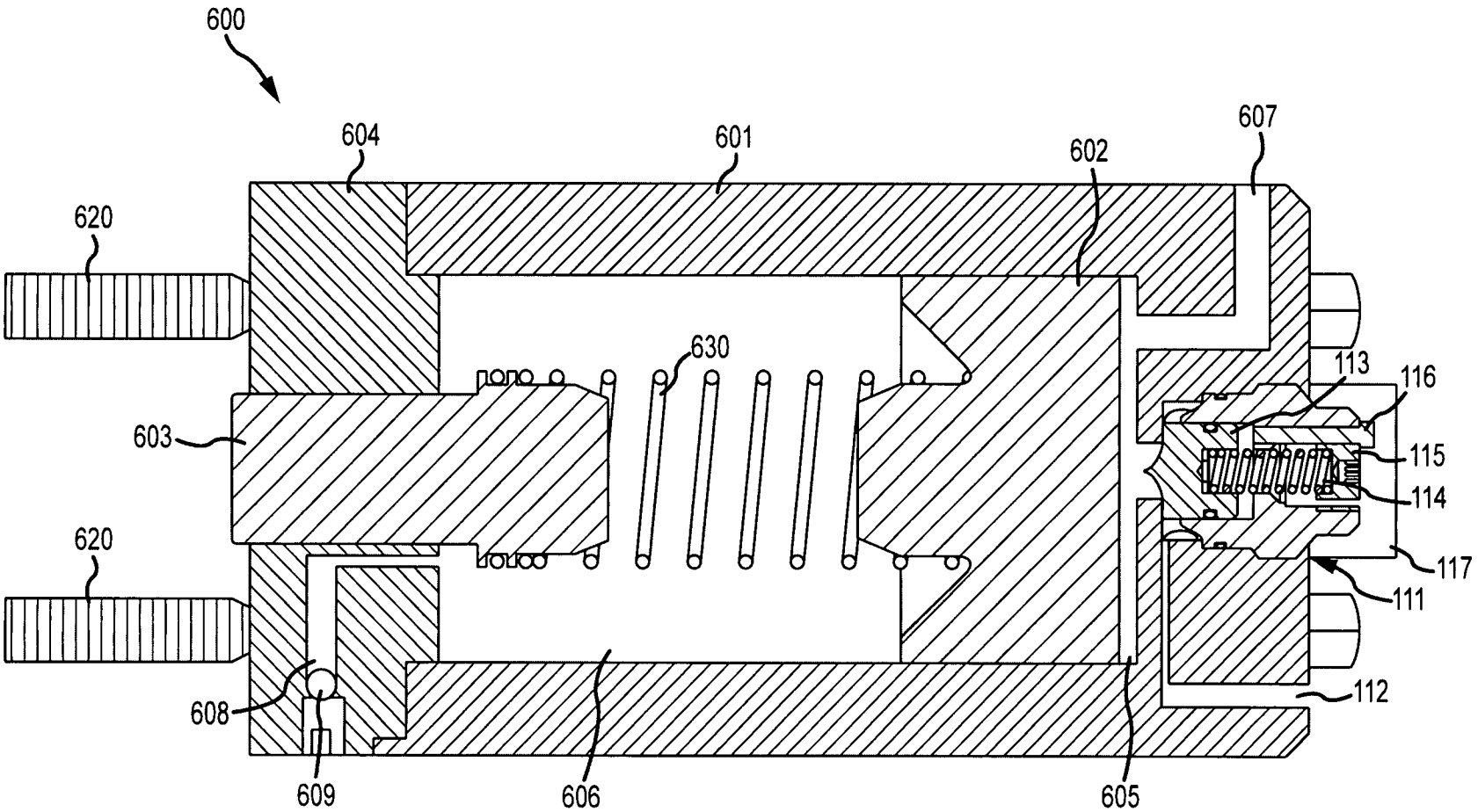
FIG. 6 shows a cross sectional view of the adjustable valve with a prior art actuator according to another embodiment of the invention.

FIG. 6 shows the adjustable valve 111 coupled to an impact cylinder 600 according to an embodiment of the invention. The impact cylinder 600 is similar to the impact cylinder 100 shown in the previous figures, except that the impact cylinder 600 does not include a bleed port. The remaining reference numbers are common to the reference numbers of the previous figures with the exception of the first digit. Therefore, it should be appreciated that the adjustable valve 111 may be utilized in prior art impact cylinders, such as the impact cylinder 600.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other cylinders, and not just to the embodiments described above and shown in the accompanying figures. Accordingly, the scope of the invention should be determined from the following claims.

I claim:

1. A fluid operated actuator (100), comprising:

a cylinder body (101);

a piston (102) movable within the cylinder body (101) between a first position and a second position, the piston (102) defining a first chamber (105) and a second chamber (106);

a fluid inlet (107) formed in the first chamber (105);

a bleed port (110) providing fluid communication between the first chamber (105) and the second chamber (106);

a striking pin (103) positioned within the second chamber (106); and a biasing member (130) coupling the striking pin to the piston (102), the biasing member (130) being configured to pull the striking pin (103) towards the second chamber (106).

2. The fluid operated actuator (100) of claim 1, wherein the bleed port (110) is formed in the piston (102).

3. The fluid operated actuator (100) of claim 1, wherein the bleed port (110) is formed in the cylinder body (101).

4. The fluid operated actuator (100) of claim 1, wherein the bleed port (110) comprises a cross sectional area smaller than the inlet port (107).

5. The fluid operated actuator (100) of claim 1, further comprising a fluid outlet (108) formed in the second chamber (106).

6. The fluid operated actuator (100) of claim 5, further comprising a check valve (109) positioned in the fluid outlet (108).

7. The fluid operated actuator (100) of claim 1, further comprising an exhaust port (112) formed in the first chamber (105).

8. The fluid operated actuator (100) of claim 7, further comprising an adjustable valve (111) configured to control fluid communication between the first chamber (105) and the exhaust port (112).

9. A method for controlling a fluid operated actuator including a piston movable within a cylinder and defining a first chamber and a second chamber, an inlet formed in the first chamber, and a bleed port providing fluid communication between the first chamber and the second chamber, the method comprising the steps of:

pressurizing the first chamber through the inlet;

actuating the piston away from a first position towards a second position;

bleeding at least some of the pressure in the first chamber into the second chamber through the bleed port as the piston is actuated towards the second position; and retracting a striking pin towards the second chamber using a biasing member as the piston moves from the second position towards the first position.

10. The method of claim 9, further comprising the step of impacting a striking pin with the piston as the piston reaches the second position.

11. The method of claim 9, further comprising the step of exhausting the first chamber thereby actuating the piston from the second position towards the first position.

12. The method of claim 9, further comprising the step of actuating a check valve provided in a fluid outlet formed in the second chamber to open the fluid outlet thereby exhausting the second chamber.

13. The method of claim 9, further comprising the step of regulating the pressure within the first chamber using a pressure relief valve.

14. The method of claim 13, wherein the pressure relief valve comprises an adjustable pressure relief valve.

15. The method of claim 9, wherein the bleed port is formed in the piston.

16. The method of claim 9, wherein the bleed port is formed in the cylinder body.

* * * * *